US006348292B1

(12) United States Patent
Pan et al.

(10) Patent No.: US 6,348,292 B1
(45) Date of Patent: Feb. 19, 2002

(54) DEVELOPER COMPOSITIONS AND PROCESSES

(75) Inventors: David H. Pan, Rochester; Christopher M. Knapp, Fairport; Weizhong Zhao, Webster; Thomas W. Smith, Penfield, all of NY (US)

(73) Assignee: Xerox Corporation, Stamford, CT (US)

( * ) Notice: Subject to any disclaimer, the term of this patent is extended or adjusted under 35 U.S.C. 154(b) by 10 days.

(21) Appl. No.: 09/777,605

(22) Filed: Feb. 6, 2001

(51) Int. Cl.[7] ..... G03G 9/135
(52) U.S. Cl. ..... 430/115; 430/115; 399/251
(58) Field of Search ..... 430/115, 116, 430/117; 399/251

(56) References Cited

U.S. PATENT DOCUMENTS 4,639,404 A * 1/1987 Uyetterhoeven et al. .... 430/115
4,707,429 A 11/1987 Trout ..... 430/115
5,019,477 A 5/1991 Felder ..... 430/115
5,028,508 A 7/1991 Lane et al. ..... 430/115
5,030,535 A 7/1991 Drappel et al. ..... 430/116
5,034,299 A 7/1991 Houle et al. ..... 430/115
5,045,425 A 9/1991 Swidler ..... 430/115
5,066,821 A 11/1991 House et al. ..... 430/137
5,096,781 A * 3/1992 Vieira et al. ..... 430/115
5,223,368 A 6/1993 Ciccarelli et al. ..... 430/110
5,306,591 A 4/1994 Larson et al. ..... 430/115
5,308,731 A 5/1994 Larson et al. ..... 430/115
5,366,840 A 11/1994 Larson et al. ..... 430/115
5,627,002 A 5/1997 Pan et al. ..... 430/115
5,826,147 A 10/1998 Liu et al. ..... 399/237
5,989,769 A * 1/1999 Mosher et al. ..... 430/115

* cited by examiner

*Primary Examiner*—John Goodrow
(74) *Attorney, Agent, or Firm*—E. O. Palazzo

(57) ABSTRACT

A liquid developer comprised of a nonpolar liquid, resin, optional colorant, and an alkaline earth charge acceptance additive.

31 Claims, No Drawings

DEVELOPER COMPOSITIONS AND PROCESSES

COPENDING APPLICATIONS AND PATENTS

In copending application U.S. Ser. No. 09/777,423 pending, filed concurrently herewith, the disclosure of which is totally incorporated herein by reference, there is illustrated a liquid developer comprised of a nonpolar liquid, thermoplastic resin, colorant, and a silica charge acceptance additive; U.S. Ser. No. 09/777,967 pending, filed concurrently herewith, the disclosure of which is totally incorporated herein by reference, illustrates a liquid developer comprised of a nonpolar liquid, thermoplastic resin, colorant, and a wax charge acceptance additive; U.S. Ser. No. 09/777,469 pending, filed concurrently herewith, the disclosure of which is totally incorporated herein by reference, illustrates a liquid developer comprised of a nonpolar liquid, thermoplastic resin, optional colorant, and an inorganic filler; U.S. Ser. No. 09/777,598 pending, filed concurrently herewith, the disclosure of which is totally incorporated herein by reference, illustrates a liquid developer comprised of a nonpolar liquid, thermoplastic resin, optional colorant, and an alumina charge acceptance additive; U.S. Ser. No. 09/777,301 pending, filed concurrently herewith, the disclosure of which is totally incorporated herein by reference, illustrates an imaging apparatus comprising a support member including a support surface for supporting a layer of marking material; a marking material supply apparatus for depositing marking material on the surface of said support member to form a layer of marking material thereon; a charging source for selectively delivering charge species to the layer of marking material in an imagewise manner to form an electrostatic latent image in the layer of marking material, wherein the electrostatic latent image includes image areas of a first charge voltage and nonimage areas of a second charge voltage distinguishable from the first charge voltage; and a separator member for selectively separating portions of the marking material layer in accordance with the latent image in the marking material layer to create a developed image and wherein said marking material is comprised of a liquid developer comprised of a nonpolar liquid, resin, colorant, and a charge acceptance component comprised of a cyclodextrin; and U.S. Ser. No. 09/777,968 pending, filed concurrently herewith, the disclosure of which is totally incorporated herein by reference, illustrates an imaging apparatus comprising a support member including a support surface for supporting a layer of marking material; a marking material supply apparatus for depositing marking material on the surface of said support member to form a layer of marking material thereon; a charging source for selectively delivering charge species to the layer of marking material in an imagewise manner to form an electrostatic latent image in the layer of marking material, wherein the electrostatic latent image includes image areas with a first charge voltage and nonimage areas with a second charge voltage distinguishable from the first charge voltage; and a separator member for selectively separating portions of the marking material layer in accordance with the latent image in the marking material layer to create a developed image and wherein said marking material is comprised of a liquid developer comprised of a nonpolar liquid, resin, colorant, and a charge acceptance component comprised of an aluminum complex.

Illustrated in U.S. Pat. Nos. 6,180,308 and 6,218,066, the disclosures of each application being totally incorporated herein by reference, are developers with charge acceptance components and imaging processes thereof.

Illustrated U.S. Pat. No. 5,627,002, the disclosure of which is totally incorporated herein by reference, is a positively charged liquid developer comprised of a nonpolar liquid, thermoplastic resin particles, pigment, a charge director, and a charge control agent comprised of a cyclodextrin or a cyclodextrin derivative containing one or more organic basic amino groups.

In U.S. Pat. No. 5,366,840, the disclosure of which is totally incorporated herein by reference, there are illustrated developers with aluminum complex components and which components may be selected as a charge acceptance additive for the developers of the present invention.

Disclosed in U.S. Pat. No. 5,826,147, the disclosure of which is totally incorporated herein by reference, is an electrostatic latent image development process wherein there is selected an imaging member with an imaging surface containing a layer of marking material and wherein imagewise charging can be accomplished with a wide beam ion source such that free mobile ions are introduced in the vicinity of an electrostatic image associated with the imaging member.

The appropriate components and processes of the above copending applications and patents may be selected for the present invention in embodiments thereof.

BACKGROUND OF THE INVENTION

This invention is generally directed to liquid developer compositions and processes thereof, and wherein there can be generated excellent developed images thereof in bipolar ion charging processes, and reverse charge imaging and printing development (RCP) processes, reference U.S. Pat. No. 5,826,147, the disclosure of which is totally incorporated herein by reference, and wherein the developer contains no charge director, or wherein the developer contains substantially no charge director. More specifically, the liquid developer of the present invention is clear in color and is comprised of a resin, a hydrocarbon carrier, and as a charge acceptor a component with, for example, a high dielectric constant, wherein high possesses values of, for example, from about 4 to about 12,000, and more specifically, wherein the charge acceptor component is comprised of an alkaline earth component, such as zirconates like calcium zirconate, metal tungstates, calcium titanates, barium titanates, and the like.

The present invention is also specifically directed to an electrostatographic imaging process wherein an electrostatic latent image bearing member containing a layer of marking material, toner particles, or liquid developer as illustrated herein and containing a charge acceptance additive, which additive may be coated on the developer, is selectively charged in an imagewise manner to create a secondary latent image corresponding to the electrostatic latent image on the imaging member. Imagewise charging can be accomplished by a wide beam charge source for introducing free mobile charges or ions in the vicinity of the electrostatic latent image coated with the layer of marking material or toner particles. The latent image causes the free mobile charges or ions to flow in an imagewise ion stream corresponding to the latent image. These charges or ions, in turn, are accepted by the marking material or toner particles, leading to imagewise charging of the marking material or toner particles with the layer of marking material or toner particles itself becoming the latent image carrier. The latent image carrying toner layer is subsequently developed by selectively separating and transferring image areas of the toner layer to a copy substrate for producing an output document.

The present invention further relates to an imaging apparatus, wherein an electrostatic latent image, including image and nonimage areas, is formed in a layer of marking material, and further wherein the latent image can be developed by selectively separating portions of the latent image bearing layer of the marking material such that the image areas reside on a first surface and the nonimage areas reside on a second surface. In a simple embodiment, the invention can be defined as an image development apparatus comprising a system for generating a first electrostatic latent image on an imaging member, wherein the electrostatic latent image includes image and nonimage areas having distinguishable charge potentials, and a system for generating a second electrostatic latent image on a layer of marking materials situated adjacent the first electrostatic latent image on the imaging member, wherein the second electrostatic latent image includes image and nonimage areas having distinguishable charge potentials of a polarity opposite to the charge potentials of the charged image and nonimage areas in the first electrostatic latent image.

The liquid developers and processes of the present invention possess a number of advantages including the development and generation of images with excellent image quality, the avoidance of a charge director, the use of the developers in a reverse charging development process, excellent, for example about 90 to about 99 percent, image transfer, and the avoidance of complex chemical charging of the developer. Poor transfer can, for example, result in poor solid area coverage if insufficient toner is transferred to the final substrate and can also cause image defects such as smears and hollowed fine features. Overcharging the toner particles can result in low reflective optical density images or poor color richness or chroma since an insufficient number of highly charged particles can discharge all the charge on the dielectric receptor causing too little toner to be deposited. To overcome or minimize such problems, the liquid toners, or developers and processes of the present invention were arrived at after extensive research. Other advantages are as illustrated herein and also include minimal or no image blooming, the generation of excellent solid area images, minimal or no developed image character defects, the enablement of clear, or colorless liquid developers, and the like.

PRIOR ART

A latent electrostatic image can be developed with toner particles dispersed in an insulating nonpolar liquid. These dispersed materials are known as liquid toners or liquid developers. The latent electrostatic image may be generated by providing a photoconductive imaging member or layer with a uniform electrostatic charge, and developing the image with a liquid developer, or colored toner particles dispersed in a nonpolar liquid which generally has a high volume resistivity in excess of $10^9$ ohm-centimeters, a low dielectric constant, for example below about 3, and a moderate vapor pressure. Generally, the toner particles are less than about 30 $\mu$m (microns) average by area size as measured with the Malvern 3600E particle sizer.

U.S. Pat. No. 5,019,477, the disclosure of which is totally incorporated herein by reference, discloses a liquid electrostatic developer comprising a nonpolar liquid, thermoplastic resin particles, and a charge director. The ionic or zwitterionic charge directors illustrated may include both negative charge directors, such as lecithin, oil-soluble petroleum sulfonates and alkyl succinimide, and positive charge directors such as cobalt and iron naphthanates. The thermoplastic resin particles can comprise a mixture of (1) a polyethylene homopolymer or a copolymer of (i) polyethylene and (ii) acrylic acid, methacrylic acid or alkyl esters thereof, wherein (ii) comprises 0.1 to 20 weight percent of the copolymer; and (2) a random copolymer (iii) of vinyl toluene and styrene and (iv) butadiene and acrylate.

U.S. Pat. No. 5,030,535, the disclosure of which is totally incorporated herein by reference, discloses a liquid developer composition comprising a liquid vehicle, a charge additive and toner pigmented particles. The toner particles may contain pigment particles and a resin selected from the group consisting of polyolefins, halogenated polyolefins and mixtures thereof.

Moreover, in U.S. Pat. No. 4,707,429, the disclosure of which is totally incorporated herein by reference, there are illustrated, for example, liquid developers with an aluminum stearate charge adjuvant. Liquid developers with charge directors are also illustrated in U.S. Pat. No. 5,045,425. Further, of interest with respect to liquid developers are U.S. Pat. Nos. 5,034,299; 5,066,821 and 5,028,508, the disclosures of which are totally incorporated herein by reference.

Illustrated in U.S. Pat. No. 5,306,591, the disclosure of which is totally incorporated herein by reference, is a liquid developer comprised of a liquid component, thermoplastic resin, an ionic or zwitterionic charge director, or directors soluble in a nonpolar liquid; and a charge additive, or charge adjuvant comprised of an imine bisquinone; in U.S. Statutory Invention Registration No. H1483 there is described a liquid developer comprised of thermoplastic resin particles, and a charge director comprised of an ammonium AB diblock copolymer, and in U.S. Pat. No. 5,307,731, the disclosure of which is totally incorporated herein by reference, there is disclosed a liquid developer comprised of a liquid, thermoplastic resin particles, a nonpolar liquid soluble charge director, and a charge adjuvant comprised of a metal hydroxycarboxylic acid, the disclosures of each of the above patents, and the Statutory Registration being totally incorporated herein by reference.

SUMMARY OF THE INVENTION

Examples of features of the present invention include.

It is a feature of the present invention to provide a liquid developer with many of the advantages illustrated herein, such as substantial increases in bipolar charging levels, compared to the same or similar liquid developer without an alkaline earth containing charge acceptance additive, improved charging levels, by as much in embodiments as about 800 percent, as measured by using the surface voltage after ion charging.

Another feature of the present invention resides in the provision of a liquid developer capable of modulated particle charging with, for example, corona ions for image quality optimization.

It is a further feature of the invention to provide positively charged and/or negatively charged liquid developers, especially colorless or clear in color developers, wherein there are selected as charge acceptance agents or charge acceptance additives alkaline earths, such as calcium zirconate, metal tungstates, calcium titanates, barium titanates, mixtures thereof and the like.

It is still a further feature of the invention to provide positively, and negatively charged liquid developers wherein developed image defects, such as smearing, loss of resolution and loss of density, and color shifts in prints having magenta images overlaid with yellow images are eliminated or minimized, and wherein the charge level of negative and positive polarities are balanced or substantially equal.

Also, in another feature of the present invention there are provided positively charged liquid developers with certain charge acceptance agents that are in embodiments superior to liquid developers with no charge director in that they can be selected for RCP development, reference U.S. Pat. No. 5,826,147, the disclosure of which is totally incorporated herein by reference, and wherein there can be generated high quality images.

Furthermore, in another feature of the present invention there are provided liquid toners that enable excellent image characteristics, and which toners enhance the positive charge of the resin selected, such as ELVAX® based resins.

These and other features of the present invention can be accomplished in embodiments by the provision of liquid developers.

Aspects of the present invention relate to a liquid developer comprised of a nonpolar liquid, resin, optional colorant, and an alkaline earth charge acceptance additive; a developer wherein the charge acceptance additive is a metal zirconate, a metal tungstate, a metal titanate, or mixtures thereof; a developer wherein the charge acceptance additive is calcium zirconate, calcium tungstate, calcium titanate, barium titanate, or mixtures thereof; a liquid developer wherein the charge acceptance agent or additive is an alkaline earth of $MgTiO_3$, $CaTiO_3$, $BaTiO_3$, $SrTiO_3$, $MgZrO_3$, $CaZrO_3$, $BaZrO_3$, $SrZrO_3$, $MgWO_4$, $CaWO_4$, $BaWO_4$, $SrWO_4$, and the like; a liquid developer wherein the liquid has a viscosity of from about 0.5 to about 500 centipoise and a resistivity equal to or greater than about $5\times10^9$, and the resin is a thermoplastic resin with an optional volume average particle diameter of from about 0.1 to about 30 microns; a developer wherein the colorant is present in an amount of from about 1 to about 60 percent by weight based on the total weight of the developer solids; a developer wherein the colorant is carbon black, cyan, magenta, yellow, blue, green, orange, red, violet and brown, or mixtures thereof; a developer wherein the charge acceptance agent is present in an amount of from about 0.05 to about 10 weight percent based on the weight of the developer solids of resin, colorant, and charge acceptance agent; a developer wherein the alkaline earth charge additive possesses a particle size diameter of from about 0.01 micron to about 2 microns; a developer wherein the colorant is present in an amount of from about 15 to about 50 weight percent; a developer wherein the charge acceptance component possesses a high dielectric constant of from about 4 to about 12,000; a developer wherein the liquid for the developer is an aliphatic hydrocarbon; a developer wherein the aliphatic hydrocarbon is a mixture of branched hydrocarbons of from about 8 to about 16 carbon atoms, or a mixture of normal hydrocarbons of from about 8 to about 16 carbon atoms; a developer wherein the resin is an alkylene polymer, a styrene polymer, an acrylate polymer, a polyester, mixtures thereof or copolymers thereof; a developer wherein the resin is poly(ethylene-co-vinylacetate), poly(ethylene-co-methacrylic acid), poly (ethylene-co-acrylic acid), or poly(propoxylated bisphenol) fumarate, or wherein the resin is selected from the group consisting of alpha-olefin/vinyl alkanoate copolymers, alpha-olefin/acrylic acid copolymers, alpha-olefin/methacrylic acid copolymers, alpha-olefin/acrylate ester copolymers, alpha-olefin/methacrylate ester copolymers, copolymers of styrene/n-butyl acrylate, methacrylate/acrylic or methacrylic acid, and unsaturated ethoxylated and propoxylated bisphenol A polyesters; a developer wherein the developer further contains a charge additive comprised of a mixture of I. a nonpolar liquid soluble organic aluminum complex that has been rendered insoluble by chemical bonding to the toner resin or by adsorption to the toner particles, II. a nonpolar liquid soluble organic phosphate mono and diester mixture derived from phosphoric acid and isotridecyl alcohol that has been rendered insoluble by bonding to the insoluble organic aluminum complex, or mixtures thereof of the formulas

I.

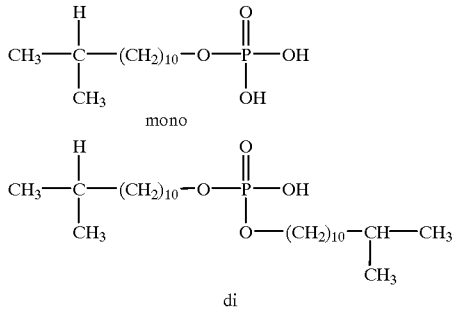

II.

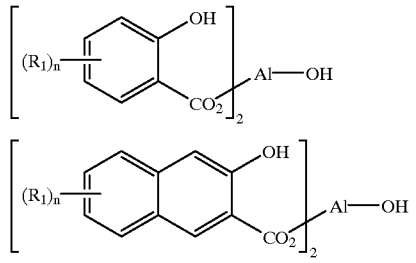

wherein $R_1$ is selected from the group consisting of hydrogen and alkyl, and n represents a number; a developer which includes a charge adjuvant; a positively or negatively charged substantially colorless liquid developer comprised of, for example, a nonpolar liquid, resin, and a charge acceptance agent comprised of, for example, an alkaline earth component; a developer wherein the alkaline earth is $MgTiO_3$, $CaTiO_3$, $BaTiO_3$, $SrTiO_3$, $MgZrO_3$, $CaZrO_3$, $BaZrO_3$, $SrZrO_3$, $MgWO_4$, $CaWO_4$, $BaWO_4$, $SrWO_4$, and the like; a developer wherein the alkaline earth is a metal zirconate, a metal tungstate, a metal titanate, a metal chromate, or a metal molybdate; a developer wherein the developer possesses a charge of from about 150 volts to about 250 volts, and which charge is measured by the surface voltage after corona ion charging; a developer comprised of from about 1 to about 20 percent solids of from about 0 to about 60 weight percent colorant, from about 0.05 to about 10 weight percent charge acceptance additive, and from about 30 to about 99.95 weight percent resin, and wherein the developer also contains from about 80 to about 99 weight percent of a nonpolar liquid, or wherein the developer is comprised of from about 5 to about 15 percent by weight of toner solids comprised of from about 15 to about 55 percent by weight of colorant, from about 0.05 to about 7 percent by weight of charge acceptance additive, and from about 38 to about 85 percent by weight of resin, and wherein the developer further contains from about 85 to about 95 percent by is weight of a nonpolar liquid; a developer comprised of a liquid, thermoplastic resin, colorant, and an alkaline earth component; a printing process wherein the liquid developer illustrated herein is selected; a xerographic apparatus comprising a charging component, an imaging component, a developer component, and a fusing component, and wherein the developer component contains the developer illustrated herein; a developer wherein the alkaline earth is barium titanate; a developer wherein the alkaline earth is calcium titanate; and liquid developers comprised of a nonpolar liquid, resin, preferably thermoplastic resin, and as a charge acceptor an alkaline earth, such as metal zirconates, metal tungstates, metal titanates, and the like, especially those alkaline earths with a diameter of, for example, from about 0.01 micron to about 2 microns and preferably from about 0.01 micron to about 0.5 micron, and which alkaline earths are commercially available from Aldrich Chemicals. In embodiments thereof of the present invention, the liquid developers can be charged in a device which first charges the developer to a first polarity, such as a positive polarity, followed by a second charging with a second charging device to reverse the developer charge polarity, such as to a negative polarity in an imagewise manner. Subsequently, a biased image bearer (IB) separates the image from the background corresponding to the charged image pattern in the toner, or developer layer. Thus, the liquid developers are preferably charged by bipolar ion charging (BIC) rather than with chemical charging.

The charge capture alkaline earths, such as calcium zirconate, metal tungstates, calcium titanates, barium titanates, and the like, can capture positive ions. Although not being desired to be limited by theory, it is believed that the alkaline earth metal zirconate, metal tungstates, metal titanates, and the like possess two types of positive metal ions; alkaline metal ions such as Ca or Ba and the like and transition metal ions such as Ti, Zr, or W. These metal ion sites capture negative ions from the corona effluent by forming covalent or coordinate covalent (dative) bonds with these negative ions. The metal ion site then becomes negatively charged, and therefore, the charge acceptor particles dispersed in the toner particles become negatively charged. Since this negatively charged charge acceptor particle resides in the immobile toner particle and not in the mobile phase or liquid carrier, the immobile toner layer itself on the dielectric surface becomes negatively charged in an imagewise manner dependent upon the charge acceptor concentration. Since the charge acceptor concentration can be the same throughout the toner layer, it is the amount of toner at a given location in the toner layer that governs the amount of charge acceptor and charge at that location. The amount of charge at a given location then results in differential development (due to different potentials) in accordance with the imagewise pattern deposited on the dielectric surface.

The negative oxide ions in the alkaline earth metal oxide particles, however, capture positive ions from the corona effluent by forming covalent or coordinate covalent (dative) bonds with these positive ions. The alkaline earth metal oxide particle then becomes positively charged, and therefore, the alkaline earth metal oxide charge acceptor itself becomes positively charged. As this positively charged particle resides in the immobile toner particle and not in the mobile phase or liquid carrier, the immobile toner layer itself on the dielectric surface becomes positively charged in an imagewise manner dependent upon the charge acceptor concentration. Since the charge acceptor concentration can be the same throughout the toner layer, it is the amount of toner at a given location in the toner layer that governs the amount of charge acceptor and charge at that location. The amount of charge at a given location then results in differential development (due to different potentials) in accordance with the imagewise pattern deposited on the dielectric surface.

In addition to the above ion charging mechanisms, there exists also a physical mechanism for ion charging by the alkaline earths. Considering DC corona (ions of one polarity), the ions move along the field lines (produced between the corotron device and ground plane and distorted by the presence of the dielectric particle) to charge the particle. For a fixed external applied field, a saturation charge $Q_P$, the Pauthenier limit, is reached when the attractive field due to the field distortion equals the repulsive field due to the charge on the particle $$Q_P=4\pi\in_0 E_0 r^2[3\in_r/(\in_r+2)],$$

where $\in_r$ is the relative permittivity of the dielectric particle with respect to its surrounding medium and r is the particle radius. $[3\in_r/(\in_r+2)]$ varies between 3 for a conducting particle (often dark-colored) with its infinite dielectric constant and 1 for an insulator with a dielectric constant of unity. The relative dielectric constant of all insulating materials range between one and 10 thus the dependence of $Q_P$ on dielectric constant is as much as a factor of 2.5 enhancement for $\in_r=10$. The Pauthenier charging does not account for the chemistry of the toner particle, and it is postulated that certain particle surface functional groups may play an important role in ion charge acceptance in liquid developers. Alkaline earth metal charge acceptor particles near the surface of the liquid toner particle increases surface $\in_r$ of the particle, (2) can create resin/charge acceptor interface for capturing corona ions, and (3) provide functional groups for acid-base interactions with corona ions. Also, it is believed that highly mobile conductive species in the continuous phase of the liquid developer actually inhibit reversible positive or negative ion charging. These charge acceptor particles are incorporated in the toner particles and should not produce conductive species in the continuous phase. In addition, the high-resolution RCP development process requires a high-solids toner cake of a very low lateral conductivity, and thereby limiting the use of conductive materials as charge acceptance agent.

While not being desired to be limited by theory, although similar to the function of charge control agents in chemically charged liquid developers in that charge acceptance agents in ion-charged liquid developers are directly involved in charging liquid developers, capturing charge using a charge acceptance agent versus a charge control agent is different mechanistically. A first difference resides in the origin and location of the species reacting with a charge acceptance agent versus the origin and location of the species reacting with a charge control agent. The species reacting with a charge acceptance agent originate in the corona effluent, which after impinging on the toner layer, become trapped in the solid phase thereof. The species reacting with a charge control agent, that is the charge director, originates by purposeful formulation of the charge director into the liquid developer and remains soluble in the liquid phase of a toner layer. Both the charge acceptance agent (in BIC-RCP developers) and the charge control additive or agent (in chemically charged developers) are insoluble in the liquid developer medium and reside on and in the toner particles, however, charge directors, used only in chemically charged developers, dissolve in the developer medium. A second difference between a charge acceptance agent and a charge control agent is that charge directors in chemically charged liquid developers charge toner particles to the desired polarity, while at the same time capturing the charge of opposite polarity so that charge neutrality is always maintained during this chemical equilibrium process. Charge separation occurs only later when the developer is placed in an electric field during development. In the BIC-RCP development process, the corona effluent used to charge the liquid developer is generated from any corona generating device and the dominant polarity of the effluent is fixed by the device. Corona ions first reach the surface of the toner layer, move through the liquid phase, and are adsorbed onto the particle and captured by the charge acceptance agent. The mobile or free corona ions in the liquid phase rapidly migrate to the ground plane. Some of these mobile ions may include counterions, if counterions are formed in the charging process. Counterions bear the opposite polarity charge versus the charged toner particles in the developer. The corona ions captured by the charge acceptance agent in or on the toner charge the developer to the same polarity as the dominant polarity charge in the corona effluent. The ion-charged liquid developer particles remain charged and most counterions, if formed in the process, exit to the ground plane so fewer counter charges remain in the developer layer. Electrical neutrality or equilibrium is not believed attainable in the BIC-RCP development process and development is not interfered with by species containing counter charges.

The slightly soluble charge acceptance agent initially resides in the liquid phase but prior to charging the toner layer the charge acceptance agent deposits on the toner particle surfaces. The concentration of charge acceptor in the nonpolar solvent is believed to be close to the charge acceptor insolubility limit at ambient temperature especially in the presence of toner particles. The adsorption affinity between soluble charge acceptor and insoluble toner particles is believed to accelerate charge acceptor adsorption such that charge acceptor insolubility occurs at a lower charge acceptor concentration versus if toner particles were not present. When the insoluble or slightly soluble charge acceptors accept (chemically bind) ions from the impinging corona effluent (BIC) or from species derived therefrom, there is obtained a net charge on the toner particles in the liquid developer. Since the toner layer contains charge acceptors capable of capturing both positive and negative ions, the net charge on the toner layer is not determined by the charge acceptor but instead is determined by the predominant ion polarity emanating from the corona. Corona effluents rich in positive ions give rise to charge acceptor capture of more positive ions and therefore provide a net positive charge to the toner layer. Corona effluents rich in negative ions give rise to charge acceptor capture of more negative ions, and therefore, provide a net negative charge to the toner layer.

The charging mechanism of a charge acceptance agent versus a charge control agent as illustrated herein is that after charging a liquid developer via the standard charge director (chemical charging) mechanism, the developer contains an equal number of charges of both polarity. An equal number of charges of both polarities in the developer hinders reverse charge imaging, so adding a charge director to the developer before depositing the uncharged developer onto the dielectric surface is undesirable. However, if corona ions in the absence of a charge director are used to charge the toner layer, the dominant ion polarity in the effluent will be accepted by the toner particles to a greater extent resulting in a net toner charge of the desired polarity and little if any counter-charged particles. When the toner layer on the dielectric receiver has more of one kind (positive or negative) of charge on it, reverse charge imaging is facilitated. With further respect to the present invention presence in the liquid developer of the charge acceptor functions to, for example, increase the Q/M of both positive and negatively charged developers. The captured charge, Q=fCV where C is the capacitance of the toner layer, V is the measured surface voltage, and f is a proportionality constant which is dependent upon the distribution of captured charge in the toner layer. M in Q/M is the total mass of the toner solids, and wherein it is believed that all charges are associated with toner particles.

Examples of specific charge acceptance additives present in the liquid developers of the present invention are various effective amounts of, for example, from about 0.001 to about 10, based on the total weight percent of the resin solids, other charge additives, colorant, such as pigments when present, and preferably from about 0.01 to about 5 weight percent or parts, include CaZrO3, $MgTiO_3$, $CaTiO_3$, $BaTiO_3$, $SrTiO_3$, $MgZrO_3$, $CaZrO_3$, $BaZrO_3$, $SrZrO_3$, $MgWO_4$, $CaWO_4$, $BaWO_4$, $SrWO_4$, $MgCrO_4$, $CaCrO_4$, $BaCrO_4$, $SrCrO_4$, $MgMoO_4$, $CaMoO_4$, $BaMoO_4$, $SrMoO_4$ and the like.

In embodiments of the present invention, the charge acceptance agents are selected in various effective amounts, such as for example, from about 0.01 to about 10, and preferably from about 1 to about 7 weight percent, and wherein the total of all solids is about 1 to about 20 percent and the total of nonpolar liquid carriers is about 80 to about 99 percent based on the weight of the total liquid developer, the toner solids can contain, for example, about 1 to about 7 weight percent alkaline earth, charge acceptor, about 15 to about 60 weight percent colorant, about 33 to about 83 weight percent resin. The developer can be clear in color, or substantially clear in color, and which developer possesses high bipolar charging values, such as for example from about 75 volts to about 250 volts and preferably from about 150 volts to about 250 volts.

Examples of nonpolar liquid carriers or components selected for the developers of the present invention include a liquid with an effective viscosity of, for example, from about 0.5 to about 500 centipoise, and preferably from about 1 to about 20 centipoise, and a resistivity equal to or greater than, for example, $5\times10^9$ ohm/cm, such as $5\times10^{13}$. Preferably, the liquid selected is a branched chain aliphatic hydrocarbon. A nonpolar liquid of the ISOPAR® series (manufactured by the Exxon Corporation) may also be used for the developers of the present invention. These hydrocarbon liquids are considered narrow portions of isoparaffinic hydrocarbon fractions with extremely high levels of purity. For example, the boiling range of ISOPAR G® is between about 157° C. and about 176° C.; ISOPAR H® is between about 176° C. and about 191° C.; ISOPAR K® is between about 177° C. and about 197° C.; ISOPAR L® is between about 188° C. and about 206° C.; ISOPAR M® is between about 207° C. and about 254° C.; and ISOPAR V® is between about 254.4° C. and about 329.4° C. ISOPAR L® has a mid-boiling point of approximately 194° C. ISOPAR M® has an auto ignition temperature of 338° C. ISOPAR G® has a flash point of 40° C. as determined by the tag closed cup method; ISOPAR H® has a flash point of 53° C. as determined by the ASTM D-56 method; ISOPAR L® has a flash point of 61° C. as determined by the ASTM D-56 method; and ISOPAR M® has a flash point of 80° C. as determined by the ASTM D-56 method. The liquids selected are generally known and should have an electrical volume resistivity in excess of $10^9$ ohm-centimeters and a dielectric constant below 3 in embodiments of the present invention. Moreover, the vapor pressure at 25° C. should be less than 10 Torr in embodiments.

While the ISOPAR® series liquids can be the preferred nonpolar liquids for use as dispersant in the liquid developers of the present invention, the essential characteristics of viscosity and resistivity may be satisfied with other suitable liquids. Specifically, the NORPAR® series available from Exxon Corporation, the SOLTROL® series available from the Phillips Petroleum Company, and the SHELLSOL® series available from the Shell Oil Company can be selected.

The amount of the liquid employed in the developer of the present invention is, for example, from about 80 to about 99 percent, and preferably from about 85 to about 95 percent by weight of the total liquid developer. The term dispersion is used to refer to the complete process of incorporating a fine particle into a liquid medium such that the final product consists of fine toner particles distributed throughout the medium. Since liquid developer consists of fine particles dispersed in a nonpolar liquid, it is often referred to as dispersion. The liquid developer dispersion consists of fine toner particles, here referred to as toner solids, and nonpolar liquid. However, other effective amounts may be selected. The total solids which include resin, other charge additives such as adjuvants, optional colorants, and the cyclodextrin or aluminum complex charge acceptance agent, content of the developer in embodiments is, for example, 0.1 to 20 percent by weight, preferably from about 3 to about 17 percent, and more preferably, from about 5 to about 15 percent by weight.

Typical suitable thermoplastic toner resins can be selected for the liquid developers of the present invention in effective amounts, for example, in the range of about 99.9 percent to about 40 percent, and preferably 80 percent to 50 percent of developer solids comprised of thermoplastic resin, charge acceptance component, and charge additive, and in embodiments other components that may comprise the toner. Generally, developer solids include the thermoplastic resin, charge additive, and charge acceptance agent. Examples of resins include ethylene vinyl acetate (EVA) copolymers (ELVA® resins, E.I DuPont de Nemours and Company, Wilmington, Del.); copolymers of ethylene and an alpha, beta-ethylenically unsaturated acid selected from the group consisting of acrylic acid and methacrylic acid; copolymers of ethylene (80 to 99.9 percent), acrylic or methacrylic acid (20 to 0.1 percent)/alkyl (C1 to C5) ester of methacrylic or acrylic acid (0.1 to 20 percent); polyethylene; polystyrene; isotactic polypropylene (crystalline); ethylene ethyl acrylate series available as BAKELITE® DPD 6169, DPDA 6182 NATURAL™ (Union Carbide Corporation, Stamford, Conn.); ethylene vinyl acetate resins like DQDA 6832 Natural 7 (Union Carbide Corporation); SURLYN® ionomer resin (E.I. DuPont de Nemours and Company); or blends thereof; polyesters; polyvinyl toluene; polyamides; styrene/butadiene copolymers; epoxy resins; acrylic resins, such as a copolymer of acrylic or methacrylic acid, and at least one alkyl ester of acrylic or methacrylic acid wherein alkyl is 1 to 20 carbon atoms, such as methyl methacrylate (50 to 90 percent)/methacrylic acid (0 to 20 percent)/ethylhexyl acrylate (10 to 50 percent); and other acrylic resins including ELVACITE® acrylic resins (E.I. DuPont de Nemours and Company); or blends thereof.

The liquid developers of the present invention can contain a colorant dispersed in the resin particles. Colorants, such as pigments or dyes and mixtures thereof, may be present to render the latent image visible. The colorant, when present, may be contained in the developer in an effective amount of, for example, from about 0.1 to about 60 percent, and preferably from about 15 to about 60, and in embodiments about 25 to about 45 percent by weight based on the total weight of solids contained in the developer. The amount of colorant used may vary depending on the use of the developer. Examples of colorants that may be selected include carbon blacks, cyan, magenta, blue, red, yellow, green, brown, violet, and mixtures thereof, available from, for example, Cabot Corporation, FANAL PINK™, PV FAST BLUE™, the colorants as illustrated in U.S. Pat. No. 5,223,368, the disclosure of which is totally incorporated herein by reference; other known pigments; and the like. Dyes are known and include food dyes.

To further increase the toner particle charge and, accordingly, increase the transfer latitude of the toner particles, charge adjuvants can be added to the developer, such as metallic soaps like magnesium stearate or magnesium octoate. These types of adjuvants may assist in enabling improved toner charging characteristics, that is, an increase in particle charge that can result in improved image development and transfer thus providing superior image quality with improved solid area coverage and excellent resolution in embodiments. The adjuvants can be added to the developer in an amount of, for example, from about 0.1 percent to about 15 percent of the total developer solids, and preferably from about 3 percent to about 7 percent of the total weight percent of solids contained in the developer.

The liquid electrostatic developer of the present invention can be prepared by a variety of processes such as, for example, mixing in a nonpolar liquid, the thermoplastic resin, charge acceptance component, other charge additives, such as charge adjuvants, and optional colorant in a manner that the resulting mixture contains, for example, about 30 to about 60 percent by weight of solids, heating the mixture to a temperature of from about 40° C. to about 110° C. until a uniform dispersion is formed; adding an additional amount of nonpolar liquid sufficient to decrease the total solids concentration of the developer to about 10 to about 30 percent by weight solids and isolating the developer by, for example, cooling the dispersion to about 10° C. to about 30° C. In the initial mixture, the resin, charge acceptance component, and optional colorant may be added separately to an appropriate vessel such as, for example, an attritor, heated ball mill, heated vibratory mill, such as a Sweco Mill manufactured by Sweco Company, Los Angeles, Calif., equipped with particulate media for dispersing and grinding, a Ross double planetary mixer manufactured by Charles Ross and Son, Hauppauge, N.Y., or a two roll heated mill, which usually requires no particulate media. Useful particulate media include materials like a spherical cylinder of stainless steel, carbon steel, alumina, ceramic, zirconia, and the like. Carbon steel particulate media are particularly useful when colorants other than black are used. A typical diameter range for the particulate media is in the range of 0.04 to 0.5 inch (approximately 1.0 to approximately 13 millimeters).

Sufficient nonpolar liquid is added to provide a dispersion of from about 30 to about 60, and more specifically from about 35 to about 45 percent solids. This mixture is then subjected to elevated temperatures during the initial mixing procedure to plasticize and soften the resin. The mixture is sufficiently heated to provide a uniform dispersion of all the solid materials of, for example, optional colorant, charge acceptance component, charge acceptance agent, and resin. However, the temperature at which this step is undertaken should not be so high as to degrade the nonpolar liquid or decompose the resin or colorant if present. Accordingly, the mixture in embodiments is heated to a temperature of from about 50° C. to about 110° C., and preferably from about 50° C. to about 80° C. The mixture may be ground in a heated ball mill or heated attritor at this temperature for about 15 minutes to 5 hours, and preferably about 60 to about 180 minutes.

After grinding at the above temperatures, an additional amount of nonpolar liquid may be added to the dispersion.

The amount of nonpolar liquid to be added should be sufficient in embodiments to decrease the total solids concentration of the dispersion to about 10 to about 30 percent by weight.

The dispersion is then cooled to about 10° C. to about 30° C., and preferably to about 15° C. to about 25° C., while mixing is continued until the resin admixture solidifies or hardens. Upon cooling, the resin admixture precipitates out of the dispersant liquid. Cooling is accomplished by methods such as the use of a cooling fluid like water, glycols such as ethylene glycol, in a jacket surrounding the mixing vessel. Cooling is accomplished, for example, in the same vessel, such as an attritor, while simultaneously grinding with particulate media to prevent the formation of a gel or solid mass; without stirring to form a gel or solid mass, followed by shredding the gel or solid mass and grinding by means of particulate media; or with stirring to form a viscous mixture and grinding by means of particulate media. The resin precipitate is cold ground for about 1 to about 36 hours, and preferably from about 2 to about 4 hours. Additional liquid may be added at any time during the preparation of the liquid developer to facilitate grinding or to dilute the developer to the appropriate percent solids needed for developing. Other processes of preparation are generally illustrated in U.S. Pat. Nos. 4,760,009; 5,017,451; 4,923,778; 4,783,389, the disclosures of which are totally incorporated herein by reference.

As illustrated herein, the developers or inks of the present invention can be selected for RCP imaging and printing methods wherein, for example, there can be selected an imaging apparatus, wherein an electrostatic latent image, including image and nonimage areas, is formed in a layer of marking material, and further wherein the latent image can be developed by selectively separating portions of the latent image bearing layer of the marking material such that the image areas reside on a first surface and the nonimage areas reside on a second surface. In embodiments of the present invention, there is thus provided an image development apparatus comprising a system for generating a first electrostatic latent image on an imaging member, wherein the electrostatic latent image includes image and nonimage areas having distinguishable charge potentials, and a system for generating a second electrostatic latent image on a layer of marking materials situated adjacent the first electrostatic latent image on the imaging member, wherein the second electrostatic latent image includes image and nonimage areas having distinguishable charge potentials of a polarity opposite to the charge potentials of the charged image and nonimage areas in the first electrostatic latent image.

Embodiments of the invention will be illustrated in the following nonlimiting Examples, it being understood that these Examples are intended to be illustrative only, and that the invention is not intended to be limited to the materials, conditions, process parameters and the like recited. The toner particles in the liquid developer can range in diameter size of from about 0.1 to about 3 micrometers, and more specifically, the particle size is about 0.5 to about 1.5 micrometers. Particle size, when measured, was measured by a Horiba CAPA-700 centrifugal automatic particle analyzer manufactured by Horiba Instruments, Inc., Irvine, Calif.

EXAMPLES

Control in Table 1=100 Percent of DuPont RX-76®; No Charge Acceptance Agent

Two hundred seventy (270) grams of NUCREL RX-76® (a copolymer of ethylene and methacrylic acid with a melt index of about 800, available from E.I. DupontDuPont de Nemours & Company, Wilmington, Del.), and 405 grams of ISOPAR-M® (Exxon Corporation) were added to a Union Process 1S attritor (Union Process Company, Akron, Ohio) charged with 0.1857 inch (4.76 millimeters) diameter carbon steel balls. The resulting mixture was milled in the attritor, which was heated with running steam through the attritor jacket to about 80° C. to about 115° C. for 2 hours. 675 Grams of ISOPAR-M® were added to the attritor at the conclusion of 2 hours, and cooled to 23° C. by running water through the attritor jacket, and the contents of the attritor were ground for an additional 4 hours. Additional ISOPAR-M®, about 900 grams, was added and the mixture was separated from the steel balls.

The liquid developer solids contained 100 percent NUCREL RX-76® toner resin. The solids level was 10.067 percent and the ISOPAR M® level was 89.933 percent of this liquid developer. The liquid developer was used as is.

Example I

In Table 1=95 Percent of DuPont RX-76®; 10 Percent Barium Titanate Charge Acceptance Agent Two hundred forty three (243) grams of NUCREL RX-76® (a copolymer of ethylene and methacrylic acid with a melt index of about 800, available from E.I. DupontDuPont de Nemours & Company, Wilmington, Del.), 27 grams of the charge acceptance additive barium titanate, $BaTiO_3$ (available from Aldrich Chemicals) and 405 grams of ISOPAR-M® (Exxon Corporation) were added to a Union Process 1S attritor (Union Process Company, Akron, Ohio) charged with 0.1857 inch (4.76 millimeters) diameter carbon steel balls. The resulting mixture was milled in the attritor, which was heated with running steam through the attritor jacket to about 80° C. to about 115° C. for 2 hours. 675 Grams of ISOPAR-M® were added to the attritor at the conclusion of 2 hours, and cooled to 23° C. by running water through the attritor jacket, and the contents of the attritor were ground for an additional 4 hours. Additional ISOPAR-M®, about 900 grams, was added and the mixture was separated from the steel balls.

The liquid developer solids contained 95 percent by weight NUCREL RX-76® toner resin and 10 percent by weight of barium titanate charge acceptance agent. The solids level was 12.436 percent and the ISOPAR M® level was 87.564 percent for this liquid developer.

Seventeen point six (17.6) grams of ISOPAR-M® were added to let down 72.4 grams of the above liquid developer so that the final liquid developer contained 10 percent solids.

Example II

In Table 1=95 Percent of DuPont RX-76®; 5 Percent Calcium Titanate Charge Acceptance Agent Two hundred fifty six point five (256.5) grams of NUCREL RX-76® (a copolymer of ethylene and methacrylic acid with a melt index of about 800, available from E.I. DupontDuPont de Nemours & Company, Wilmington, Del.), 13.5 grams of calcium titanate (available from Aldrich Chemicals) and 405 grams of ISOPAR-M® (Exxon Corporation) were added to a Union Process 1S attritor (Union Process Company, Akron, Ohio) charged with 0.1857 inch (4.76 millimeters) diameter carbon steel balls. The resulting mixture was milled in the attritor, which was heated with running steam through the attritor jacket to about 80° C. to about 115° C. for 2 hours. 675 Grams of ISOPAR-M® were added to the attritor at the conclusion of 2 hours, and cooled to 23° C. by running water through the attritor jacket, and the contents of the attritor were ground for an additional 4 hours. Additional ISOPAR-M®, about 900 grams, was added and the mixture was separated from the steel balls.

The liquid developer solids contained 95 percent NUCREL RX-76® toner resin and 5 percent calcium titanate charge acceptance agent. The solids level was 10.001 percent and the ISOPAR M® level was 89.999 percent for this liquid developer. The liquid developer was evaluated in Example V.

Example III

In Table 1=95 Percent of DuPont RX-76®; 5 Percent Calcium Zirconate Charge Acceptance Agent Two hundred fifty six point five (256.5) grams of NUCREL RX-76® (a copolymer of ethylene and methacrylic acid with a melt index of about 800, available from E.I. DuPont de Nemours & Company, Wilmington, Del.), 13.5 grams of calcium zirconate (available from Aldrich Chemicals) and 405 grams of ISOPAR-M® (Exxon Corporation) were added to a Union Process 1S attritor (Union Process Company, Akron, Ohio) charged with 0.1857 inch (4.76 millimeters) diameter carbon steel balls. The mixture was milled in the attritor, which was heated with running steam through the attritor jacket to about 80° C. to about 115° C. for 2 hours. 675 Grams of ISOPAR-M® were added to the attritor at the conclusion of 2 hours, and cooled to 23° C. by running water through the attritor jacket, and the contents of the attritor were ground for an additional 4 hours. Additional ISOPAR-M®, about 900 grams, was added and the mixture was separated from the steel balls.

The liquid developer solids contained 95 percent NUCREL RX-76® toner resin and 5 percent calcium zirconate charge acceptance agent. The solids level was 10.235 percent and the ISOPAR M® level was 89.765 percent of this liquid developer. The liquid developer was evaluated in Example V.

Example IV

In Table 1=95 Percent of DuPont RX-76®; 5 Percent Calcium Tungstate Charge Acceptance Agent Two hundred fifty six point five (256.5) grams of NUCREL RX-76® (a copolymer of ethylene and methacrylic acid with a melt index of about 800, available from E.I. DupontDuPont de Nemours & Company, Wilmington, Del.), 13.5 grams of calcium zirconate (available from Aldrich Chemicals) and 405 grams of ISOPAR-M® (Exxon Corporation) were added to a Union Process 1S attritor (Union Process Company, Akron, Ohio) charged with 0.1857 inch (4.76 millimeters) diameter carbon steel balls. The mixture was milled in the attritor, which was heated with running steam through the attritor jacket to about 80° C. to about 115° C. for 2 hours. 675 Grams of ISOPAR-M® were added to the attritor at the conclusion of 2 hours, and cooled to 23° C. by running water through the attritor jacket, and the contents of the attritor were ground for an additional 4 hours. Additional ISOPAR-M®, about 900 grams, was added and the mixture was separated from the steel balls.

The liquid developer solids contained 95 percent NUCREL RX-76® toner resin and 5 percent calcium tungstate charge acceptance agent. The solids level was 10.113 percent and the ISOPAR M® level was 89.887 percent of this liquid developer. The liquid developer was evaluated in Example V.

Example V

Charging Voltage Test Results

To better understand the effect of the charge acceptor on RCP ink charging, a toner layer surface-charging voltage test was employed.

Ink (toner) layers with thickness of about 15 $\mu$m were generated by draw bar coating. Scorotrons were used as charging and recharging devices.

The positive and negative toner layer charge-capturing propensity can be measured by several techniques. One technique involves first charging the toner layer with a scorotron for a fixed time, e.g. 2 seconds, and then monitoring the surface voltage decay as a function of time as soon as charging is turned off. This can be accomplished for both positively and negatively charged toner layers.

TABLE 1

| | Ink Composition | | | | | Test Results* | | | |
|---|---|---|---|---|---|---|---|---|---|
| | | | | | | Positive Charging | | Negative Charging | |
| | Solid Phase | | | Liquid Phase | | | | | |
| | Resin | Pigment | Charge Acceptance Agent | Carrier fluid | Charge director | Initial Surface Voltage | Surface Voltage after 5 seconds | Initial Surface Voltage | Surface Voltage after 5 seconds |
| Control | 100% Nucrel RX-76 | No | No | Isopar M | No | 91 | 54 | −49 | −24 |
| Example I | 90% Nucrel RX-76 | No | 10% Barium Titanate | Isopar M | No | 178 | 135 | −190 | −151 |
| Example II | 95% Nucrel RX-76 | No | 5% Calcium Titanate | Isopar M | No | 188 | 149 | −237 | −210 |
| Example III | 95% Nucrel RX-76 | No | 5% Calcium Zirconate | Isopar M | No | 196 | 160 | −207 | −168 |
| Example IV | 95% Nucrel RX-76 | No | 5% Calcium Tungstate | Isopar M | No | 122 | 85 | −162 | −91 |

*All tests were carried out using +250 V and −250 V scorotron grid voltages for + and − charging, respectively.

The data in the Control of Table 1 indicate that the ink layer with no charge acceptor captured or accepted negative charge equivalent to a surface voltage of −49 volts and decayed to −24 volts thereof after 5 seconds. The same ink layer, when charged positively, captured or accepted +91 volts initially, but then the voltage of this control ink layer decayed to +54 volts in 5 seconds.

The data in Example I of Table 1, wherein 10 weight percent barium titanate was used as the charge acceptance agent, indicates that the ink layer, when charged negatively, captured or accepted negative charge equivalent to a surface voltage of −190 volts and maintained −151 volts thereof for 5 seconds. However, when charged positively, the same ink layer captured or accepted +178 volts and decayed slowly to +135 volts. When charged negatively, the ink layer containing the 10 weight percent barium titanate charge acceptance agent improved (versus the control without barium titanate) in negative charging level from −49 volts to −190 volts (388 percent improvement). Comparing the decay for the 5 second negative surface voltage in Example I versus the Control indicates that in Example I the 5 second negative surface voltage was −151 volts (629 percent improvement) whereas in the Control the 5 second negative surface voltage was −24 volts. When charged positively, the ink layer containing the 10 weight barium titanate charge acceptance agent improved in positive charging level from +91 volts to +178 volts (196 percent improvement). Comparing the decay for the 5 second positive surface voltage in Example I versus the Control indicates that in Example I the 5 second positive surface voltage was +135 volts (250 percent improvement) whereas in the Control the 5 second positive surface voltage was only +54 volts.

The data in Example II of Table 1, wherein 5 weight percent calcium titanate was used as the charge acceptance agent, indicate that the ink layer, when charged negatively, captured or accepted negative charge equivalent to a surface voltage of −237 volts and maintained −210 volts thereof for 5 seconds. However, when charged positively, the same ink layer captured or accepted +188 volts and decayed slowly to +149 volts in 5 seconds. When charged negatively, the ink layer containing the 5 weight percent calcium titanate charge acceptance agent improved (versus the control without calcium titanate) in negative charging level from −49 volts to −237 volts (484 percent improvement). Comparing the decay for the 5 second negative surface voltage in Example II versus the Control indicates that in Example II the 5 second negative surface voltage was −210 volts (875 percent improvement) whereas in the Control the 5 second negative surface voltage was −24 volts. When charged positively, the ink layer containing the 5 weight calcium titanate charge acceptance agent improved in positive charging level from +91 volts to +188 volts (207 percent improvement). Comparing the decay for the 5 second positive surface voltage in Example II versus the Control indicates that in Example II the 5 second positive surface voltage was +149 volts (276 percent improvement) whereas in the Control the 5 second positive surface voltage was only +54 volts.

The data in Example III of Table 1, wherein 5 weight percent calcium zirconate was used as the charge acceptance agent, indicate that the ink layer, when charged negatively, captured or accepted negative charge equivalent to a surface voltage of −207 volts and maintained −168 volts thereof for 5 seconds. However, when charged positively, the same ink layer captured or accepted +196 volts and decayed slowly to +160 volts in 5 seconds. When charged negatively, the ink layer containing the 5 weight percent calcium zirconate charge acceptance agent improved (versus the control without calcium zirconate) in negative charging level from −49 volts to −207 volts (422 percent improvement). Comparing the decay for the 5 second negative surface voltage in Example III versus the Control indicates that in Example III the 5 second negative surface voltage was −168 volts (700 percent improvement) whereas in the Control the 5 second negative surface voltage was −24 volts. When charged positively, the ink layer containing the 5 weight calcium zirconate charge acceptance agent improved in positive charging level from +91 volts to +196 volts (215 percent improvement). Comparing the decay for the 5 second positive surface voltage in Example III versus the Control indicates that in Example III the 5 second positive surface voltage was +160 volts (296 percent improvement) whereas in the Control the 5 second positive surface voltage was only +54 volts.

The data in Example IV of Table 1, wherein 5 weight percent calcium tungstate was used as the charge acceptance agent, indicate that the ink layer, when charged negatively, captured or accepted negative charge equivalent to a surface voltage of −162 volts and maintained −91 volts thereof for 5 seconds. However, when charged positively, the same ink layer captured or accepted +122 volts and decayed slowly to +85 volts in 5 seconds. When charged negatively, the ink layer containing the 5 weight percent calcium tungstate charge acceptance agent improved (versus the control without calcium tungstate) in negative charging level from −49 volts to −162 volts (331 percent improvement). Comparing the decay for the 5 second negative surface voltage in Example IV versus the Control indicates that in Example IV the 5 second negative surface voltage was −91 volts (379 percent improvement) whereas in the Control the 5 second negative surface voltage was −24 volts. When charged positively, the ink layer containing the 5 weight calcium tungstate charge acceptance agent improved in positive charging level from +91 volts to +122 volts (134 percent improvement). Comparing the decay for the 5 second positive surface voltage in Example IV versus the Control indicates that in Example IV the 5 second positive surface voltage was +85 volts (157 percent improvement) whereas in the Control the 5 second positive surface voltage was only +54 volts.

Other embodiments and modifications of the present invention may occur to those skilled in the art subsequent to a review of the information presented herein; these embodiments and modifications, as well as equivalents thereof, are also included within the scope of this invention.

What is claimed is:

1. A liquid developer comprised of a nonpolar liquid, resin, optional colorant, and an alkaline earth charge acceptance additive.

2. A developer in accordance with claim 1 wherein said charge acceptance additive is a metal zirconate, a metal tungstate, a metal titanate, or mixtures thereof.

3. A developer in accordance with claim 1 wherein said charge acceptance additive is calcium zirconate, calcium tungstate, calcium titanate, barium titanate, or mixtures thereof.

4. A liquid developer in accordance with claim 1 wherein said alkaline earth is $MgTiO_3$, $CaTiO_3$, $BaTiO_3$, $SrTiO_3$, $MgZrO_3$, $CaZrO_3$, $BaZrO_3$, $SrZrO_3$, $MgWO_4$, $CaWO_4$, $BaWO_4$, or $SrWO_4$.

5. A liquid developer in accordance with claim 1 wherein said liquid has a viscosity of from about 0.5 to about 500 centipoise and resistivity equal to or greater than about $5\times10^9$, and said resin is a thermoplastic resin with a volume average particle diameter of from about 0.1 to about 30 microns.

6. A developer in accordance with claim 1 wherein the colorant is present in an amount of from about 1 to about 60 percent by weight based on the total weight of the developer solids.

7. A developer in accordance with claim 1 wherein the colorant is carbon black, cyan, magenta, yellow, blue, green, orange, red, violet and brown, or mixtures thereof.

8. A developer in accordance with claim 1 wherein the charge acceptance agent is present in an amount of from about 0.05 to about 10 weight percent based on the weight of the developer solids of resin, colorant, and charge acceptance agent.

9. A developer in accordance with claim 1 wherein the alkaline earth possesses a particle size diameter of from about 0.01 micron to about 2 microns.

10. A developer in accordance with claim 1 wherein the colorant is present in an amount of from about 15 to about 50 weight percent.

11. A developer in accordance with claim 1 wherein the charge acceptance component possesses a high dielectric constant of from about 4 to about 12,000.

12. A developer in accordance with claim 1 wherein the liquid for said developer is an aliphatic hydrocarbon.

13. A developer in accordance with claim 12 wherein the aliphatic hydrocarbon is a mixture of branched hydrocarbons of from about 8 to about 16 carbon atoms, or a mixture of normal hydrocarbons of from about 8 to about 16 carbon atoms.

14. A developer in accordance with claim 1 wherein the resin is an alkylene polymer, a styrene polymer, an acrylate polymer, a polyester, mixtures thereof or copolymers thereof.

15. A developer in accordance with claim 1 wherein the resin is poly(ethylene-co-vinylacetate), poly(ethylene-co-methacrylic acid), poly(ethylene-co-acrylic acid), or poly (propoxylated bisphenol) fumarate, or wherein the resin is selected from the group consisting of alpha-olefin/vinyl alkanoate copolymers, alpha-olefin/acrylic acid copolymers, alpha-olefin/methacrylic acid copolymers, alpha-olefin/acrylate ester copolymers, alpha-olefin/methacrylate ester copolymers, copolymers of styrene/n-butyl acrylate, methacrylate/acrylic or methacrylic acid, and unsaturated ethoxylated and propoxylated bisphenol A polyesters.

16. A developer in accordance with claim 1 wherein the developer further contains a charge additive comprised of a mixture of I. a nonpolar liquid soluble organic aluminum complex that has been rendered insoluble by chemical bonding to the toner resin or by adsorption to the toner particles, II. a nonpolar liquid soluble organic phosphate mono and diester mixture derived from phosphoric acid and isotridecyl alcohol that has been rendered insoluble by bonding to the insoluble organic aluminum complex, or mixtures thereof of the formulas

I.

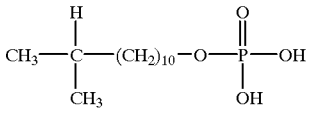

mono

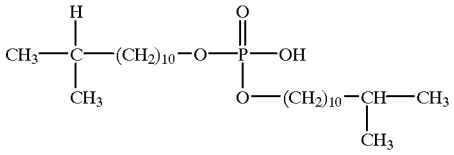

di

II.

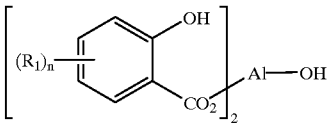

-continued

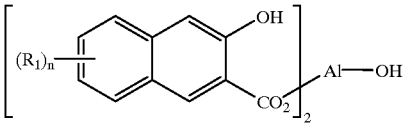

wherein $R_1$ is selected from the group consisting of hydrogen and alkyl, and n represents a number.

17. A developer in accordance with claim 1 wherein said developer further includes a charge adjuvant.

18. A positively or negatively charged substantially colorless liquid developer comprised of a nonpolar liquid, resin, and a charge acceptance agent comprised of an alkaline earth component.

19. A developer in accordance with claim 18 wherein the alkaline earth is $MgTiO_3$, $CaTiO_3$, $BaTiO_3$, $SrTiO_3$, $MgZrO_3$, $CaZrO_3$, $BaZrO_3$, $SrZrO_3$, $MgWO_4$, $CaWO_4$, $BaWO_4$, or $SrWO_4$.

20. A developer in accordance with claim 18 wherein the alkaline earth is a metal zirconate, a metal tungstate, a metal titanate, a metal chromate, or a metal molybdate.

21. A developer in accordance with claim 18 wherein the developer possesses a charge of from about 150 volts to about 250 volts, and which charge is measured by surface voltage after corona ion charging.

22. A developer in accordance with claim 18 further containing a colorant.

23. A developer in accordance with claim 1 comprised of from about 1 to about 20 percent solids of from about 0 to about 60 weight percent colorant, from about 0.05 to about 10 weight percent charge acceptance additive, and from about 30 to about 99.95 weight percent resin, and wherein the developer also contains from about 80 to about 99 weight percent of a nonpolar liquid, or wherein said developer is comprised of from about 5 to about 15 percent by weight of toner solids comprised of from about 15 to about 55 percent by weight of colorant, from about 0.05 to about 7 percent by weight of charge acceptance additive, and from about 38 to about 85 percent by weight of resin, and wherein the developer further contains from about 85 to about 95 percent by weight of a nonpolar liquid.

24. A developer comprised of a liquid, thermoplastic resin, colorant, and an alkaline earth component.

25. A printing process wherein the liquid developer of claim 1 is selected.

26. A xerographic apparatus comprising a charging component, an imaging component, a developer component, and a fusing component, and wherein said developer component contains the developer of claim 1.

27. A developer in accordance with claim 1 wherein said alkaline earth is barium titanate.

28. A developer in accordance with claim 1 wherein said alkaline earth is calcium titanate.

29. A liquid developer comprised of a nonpolar liquid, resin colorant, and an alkaline earth charge acceptance additive, and wherein said additive captures negative ions.

30. A liquid developer in accordance with claim 29 wherein said charge acceptance additive is a metal zirconate, a metal tungstate, a metal titanate, or mixtures thereof.

31. A positively or negatively charged substantially colorless liquid developer comprised of a nonpolar liquid, resin, and a charge acceptance agent comprised of an alkaline earth component, and wherein the alkaline earth is $MgTiO_3$, $CaTiO_3$, $BaTiO_3$, $SrTiO_3$, $MgZrO_3$, $CaZrO_3$, $BaZrO_3$, $SrZrO_3$, $MgWO_4$, $CaWO_4$, $BaWO_4$, or $SrWO_4$.

* * * * *